US011066863B2

(12) United States Patent
de Marco

(10) Patent No.: US 11,066,863 B2
(45) Date of Patent: Jul. 20, 2021

(54) DEVICE FOR ADJUSTING THE ELEVATION OF A PIECE

(71) Applicant: A. RAYMOND ET CIE, Grenoble (FR)

(72) Inventor: Cyril de Marco, Grenoble (FR)

(73) Assignee: A. RAYMOND ET CIE, Grenoble (FR)

( * ) Notice: Subject to any disclaimer, the term of this patent is extended or adjusted under 35 U.S.C. 154(b) by 0 days.

(21) Appl. No.: 16/370,504

(22) Filed: Mar. 29, 2019

(65) Prior Publication Data

US 2019/0301222 A1 Oct. 3, 2019

(30) Foreign Application Priority Data

Mar. 30, 2018 (FR) ..... 1852781

(51) Int. Cl.
*E05F 5/02* (2006.01)

(52) U.S. Cl.
CPC ..... *E05F 5/022* (2013.01); *E05F 5/025* (2013.01); *E05Y 2600/12* (2013.01); *E05Y 2600/14* (2013.01); *E05Y 2600/324* (2013.01); *E05Y 2600/56* (2013.01); *E05Y 2900/536* (2013.01); *E05Y 2900/546* (2013.01); *E05Y 2900/548* (2013.01)

(58) Field of Classification Search
CPC ... E05F 5/02; E05F 5/022; E05F 5/025; E05F 5/06
USPC ..... 16/82, 86 A
See application file for complete search history.

(56) References Cited

U.S. PATENT DOCUMENTS 5,735,511 A * 4/1998 Stocker ..... E05F 5/022 248/569
6,119,306 A * 9/2000 Antonucci ..... E05F 5/022 16/86 A
7,114,217 B2 10/2006 Matsuzawa et al.
(Continued)

FOREIGN PATENT DOCUMENTS

DE 29716111 U1 1/1998
EP 3653823 A1 5/2020
(Continued)

OTHER PUBLICATIONS

French Search Report for French Application No. 1852781 dated Dec. 4, 2018, 2 pages.
(Continued)

*Primary Examiner* — Jeffrey O'Brien
(74) *Attorney, Agent, or Firm* — TraskBritt

(57) ABSTRACT

A device for adjusting an elevation of a piece comprises a body and a pin. The body is intended to be secured to a support, and has an internal surface defining a central cylinder provided with an internal thread and having a first opening. The pin has an external thread, a first end for carrying the piece, and a second end. The pin and the body are connected to one another through their respective threads. The pin can, when rotated, move in a longitudinal direction to adjust the elevation of its first end. The pin has at least two longitudinal slots on its second end to define at least two flexible legs. The body has at least one boss on its internal surface configured to bend the flexible legs and to fit into one of the slots during the rotational movement of the pin so as to index an elevational position of the piece.

3 Claims, 2 Drawing Sheets

(56) References Cited

U.S. PATENT DOCUMENTS

| | | | | |
|---|---|---|---|---|
| 8,052,233 | B2 * | 11/2011 | Netzer | A47B 95/043 312/330.1 |
| 8,984,715 | B2 * | 3/2015 | Kaji | E05F 5/022 16/86 R |
| 9,212,512 | B2 * | 12/2015 | Nakasone | F16F 1/128 |
| 9,580,951 | B2 * | 2/2017 | Duprez | B60J 5/107 |
| 10,570,655 | B2 * | 2/2020 | Nakasone | E05C 19/16 |
| 10,619,394 | B2 * | 4/2020 | Bell | E05F 5/022 |
| 2004/0025290 | A1 * | 2/2004 | Novarino | E05F 5/022 16/86 A |
| 2006/0101615 | A1 * | 5/2006 | Pinzl | E05F 5/022 16/82 |
| 2011/0167590 | A1 * | 7/2011 | Ukai | E05F 5/022 16/85 |
| 2019/0242169 | A1 * | 8/2019 | Diez Herrera | E05F 5/025 |
| 2019/0309555 | A1 * | 10/2019 | Diez Herrera | B29C 45/16 |
| 2020/0095817 | A1 * | 3/2020 | Cahill | E05F 5/022 |

FOREIGN PATENT DOCUMENTS

| | | | |
|---|---|---|---|
| FR | 3002574 | B1 | 3/2015 |
| WO | 99/61740 | A1 | 12/1999 |

OTHER PUBLICATIONS

European Extended Search Report and Opinion for European Application No. 19164432, dated Jul. 24, 2019, 7 pages.

* cited by examiner

DEVICE FOR ADJUSTING THE ELEVATION OF A PIECE

PRIORITY CLAIM

This application claims the benefit of the filing date of French Patent Application Serial No. 1852781, filed Mar. 30, 2018, for "Device for Adjusting the Elevation of a Piece."

TECHNICAL FIELD

The present disclosure relates to a device for adjusting the elevation of an end piece. The piece can be a stop, for example for an opening part of a motor vehicle such as a hood, a trunk door, a tailgate. By adjusting the elevation of the piece, the opening part can be precisely positioned in the closed position with the rest of the body.

BACKGROUND

Such a device is known from French Patent No. FR 3002574 B1. It comprises a sleeve intended to be secured to the vehicle and an adjusting element, bearing a stop, which can slide into the sleeve in order to place the stop at a given height. The device is then locked by imparting a movement to the adjusting element to place retaining lugs into locking grooves and to bring together teeth and grooves arranged respectively on the adjusting elements and on the sleeve to lock any movement of the adjusting element and to fix the height of the stop.

The solution proposed in this document effectively makes it possible to position the stop at a determined height. However, it does not allow this height to be easily adjusted, especially after the device has been placed in the locking position.

German Publication No. DE29716111 U1 discloses a device for placing a stop at a determined height. In this document, the height is indexed by means of flexible elements bearing lugs, arranged on the sleeve, which indent themselves in grooves of the adjusting element.

The solution proposed in this document is particularly fragile and implies that the flexible elements may break when the adjusting element is screwed into the sleeve. In addition, this device requires a sufficient space in its environment for the flexible elements to be able to deform.

BRIEF SUMMARY

The purpose of the present disclosure is to provide for an alternative solution that does not have the above-mentioned drawbacks. An object of the disclosure is to enable the simple adjustment, for example by indexation, of the elevation of a piece.

In order to achieve, at least in part, this object, the subject matter of the present disclosure includes a device for adjusting the elevation of a piece, the device comprising:

- a body intended to be secured to a support, the body defining a central cylinder having an internal thread and a first opening;
- a pin with an external thread, a first end for bearing the piece, and a second end.

The pin and the body are connected to one another through their respective threads, and the pin can, when rotated, move in a longitudinal direction to adjust the elevation of its first end.

According to the disclosure, the pin is provided with at least two longitudinal slots on its second end to define at least two flexible legs. The body has, on its internal surface, two bosses respectively arranged on longitudinal arms of a handle. The bosses are configured to bend the flexible legs and to fit into the slots during the rotational movement of the pin and thus index the elevation position of the piece.

According to other advantageous and non-limiting characteristics of the disclosure, taken either separately or in any technically feasible combination:

- the flexible legs are provided with a shoulder to bear against a peripheral edge of the body;
- the boss is carried by a longitudinal arm of a handle;
- a stop is assembled at the first end of the pin;
- the pin is provided with four slots.

BRIEF DESCRIPTION OF THE DRAWINGS

Further characteristics and advantages of the disclosure will appear from the following detailed description of example embodiments of the invention, made in reference to the appended figures, among which.

DETAILED DESCRIPTION

Figure 1:
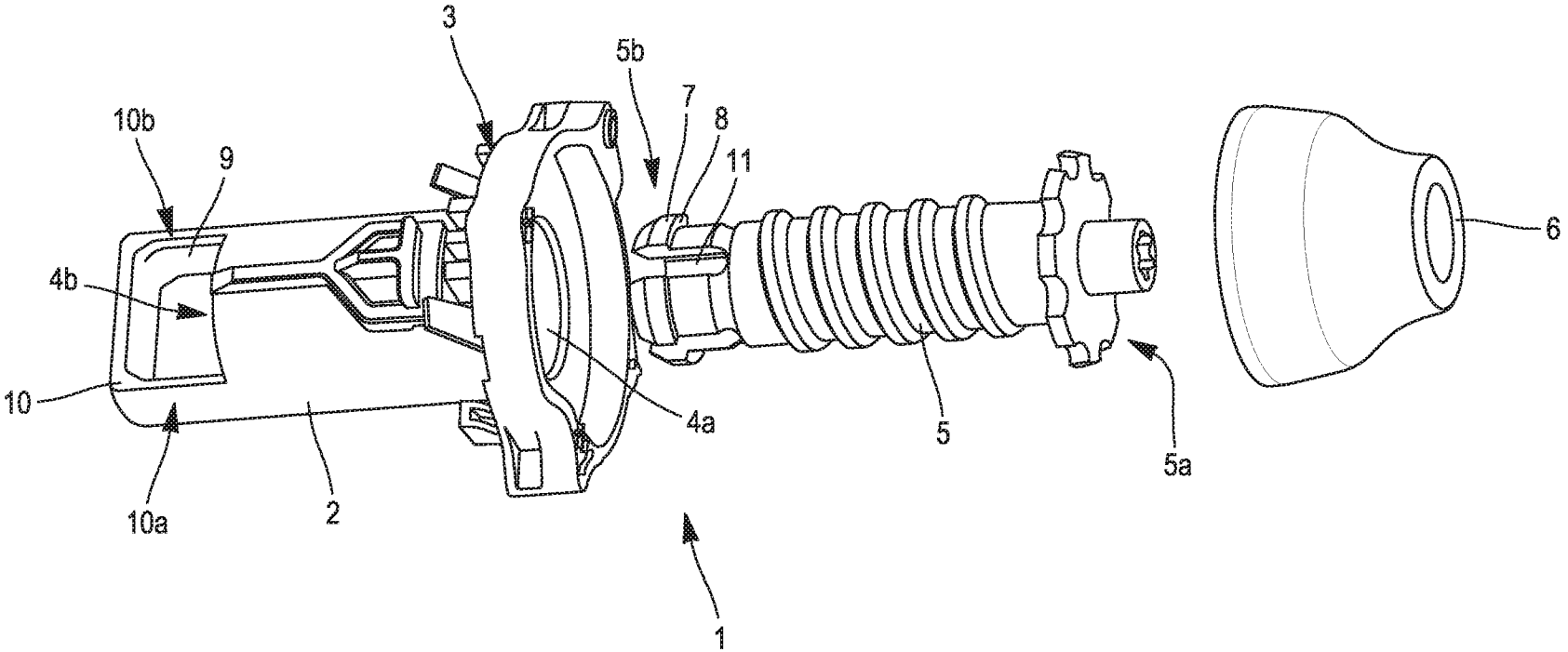
FIG. 1 is an exploded view of a device according to the present disclosure.
Figure 2:
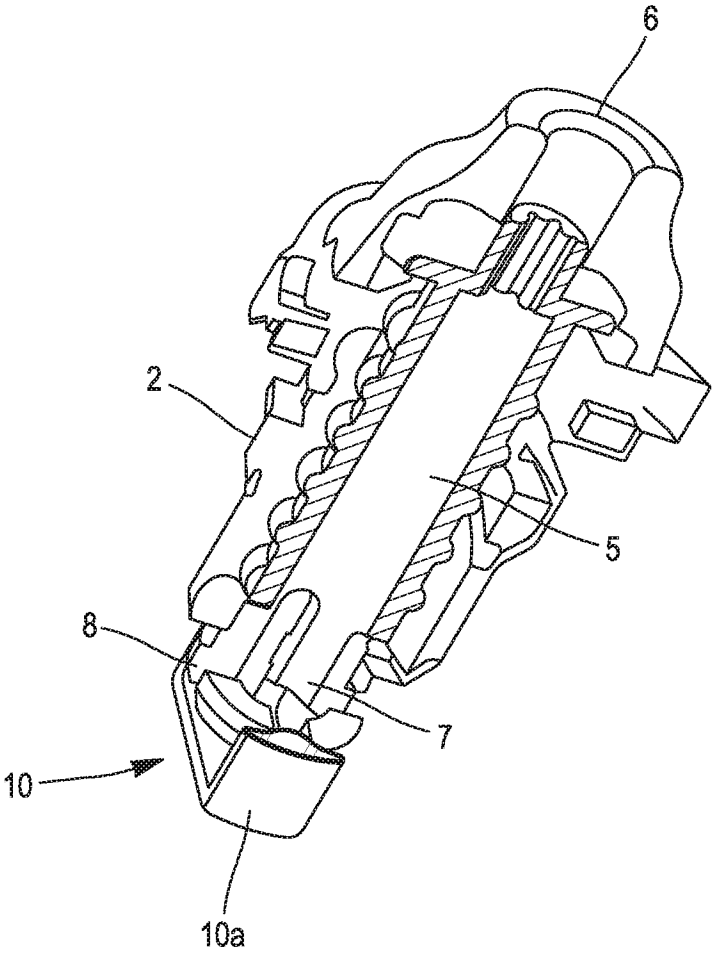
FIG. 2 is a sectional view of the device of FIG. 1 according to the present disclosure.

With reference to FIGS. 1 and 2, an adjustment device 1 for adjusting the elevation of an end piece according to the present disclosure comprises a body 2 intended to be secured to a support. "Elevation" is used in this application to refer to the distance between the end piece and a reference point on the body 2. In the case where the adjustment device 1 is a stop of a motor vehicle opening part, the support may consist of a body element or the vehicle chassis.

Whatever the nature of the support, it is provided with an opening into which the body 2 of the adjustment device 1 can be inserted to be retained. For this purpose, the body 2 may be provided with retaining devices, such as flexible legs to enable the body 2 to be elastically interlocked to the support, or locking means 3 to secure the body 2 to the support.

Advantageously, the body 2 can be provided with a support flange to rest upon the support. The flange may be fitted with a sealing washer, for example made of elastomer, to seal the opening into which the body 2 has been inserted.

The body 2 extends in a longitudinal direction and defines a central cylinder with a circular base and an internal thread. The cylinder has a first opening 4*a* and a second opening 4*b* on either side of the body 2.

An adjustment device 1 as described herein also has a pin 5, also cylindrical in shape, with an external thread. This pin 5 has a first end 5*a* configured to receive, for example by interlocking features, adhesive, fasteners, or any other securing means, the end piece 6, the elevation of which is to be adjusted. In the example shown in the figures, this end piece 6 comprises a stop made of an elastomeric material.

The dimensions of the pin 5 and the central cylinder of the body 2 are chosen so that the two parts can be connected together by screwing same together using their respective threads. The pin 5, when driven in rotation, can then move in a longitudinal direction, which enables the elevation of the end piece 6, in this case the elastomer stop, to be adjusted.

As is well known, per se, the pitch of the internal threads of the central and external cylinder of the pin is chosen to determine the variation in elevation of the end piece 6 for each complete rotation of the pin 5 in the body 2. For example, by choosing a 4 mm pitch, the elevation of the end piece 6 will vary by + or −2 mm from a nominal elevation, by imposing a half-turn rotation of the pin 5 in either direction.

Continuing the description of FIGS. 1 and 2, the second end 5*b* of the pin 5 is provided with at least two longitudinal slots 11. These two slots 11 define at least two flexible legs 7 on the second end 5*b* of the pin 5. As will be made apparent later in this description, more than two slots 11 and, therefore, more than two flexible legs 7 can be provided.

The flexible legs 7, in the advantageous example shown in the figures, each have a shoulder 8. When the second end 5*b* of the pin 5 is inserted into the first opening 4*a* of the body 2 to be screwed into the central cylinder, the flexible legs 7 retract inwardly to enable the longitudinal movement of the pin 5 into the body 2. Once the pin 5 has gone sufficiently far into the body 2 to expose the flexible legs 7 on the side of the second opening of this body 2, the flexible legs 7 return to their relaxed positions and place the shoulders 8 in abutment with the peripheral edge of the body 2. This mechanism prevents the pin 5 from unscrewing and makes it possible to determine the maximum elevation of the end piece 6 with respect to the body 2. This also facilitates assembly by enabling pre-piercing and pre-holding of the pin 5 to the body 2 before screwing and adjusting the pin 5.

Figure 3:
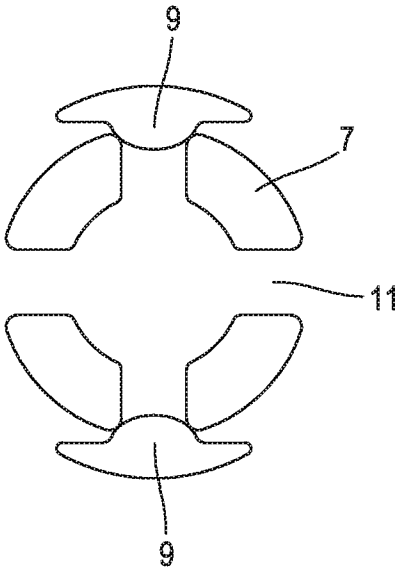
FIG. 3 is a cross-sectional view taken at one end of a pin of the device of FIGS. 1 and 2 according to the present disclosure.

As shown in FIG. 1 and in the cross-sectional view of the body 2 shown in FIG. 3, the body 2 also has at least one boss 9 on its internal surface, i.e., the internal surface facing the pin 5. In the example shown in these figures, the body 2 has two bosses 9 facing each other, respectively formed on the longitudinal arms 10*a*, 10*b* of a handle 10.

The bosses 9 provide a restriction of the diameter of the internal cylinder of the body 2 so that they are likely to deform the flexible legs 7 of the pin 5 when it is placed in an angular position in the body 2 in which the flexible legs 7 are aligned with the bosses 9. The bosses 9 are also configured to fit into some of the slots 11 when the pin 5 is oriented at an angular position in the body 2 in which some slots 11 are aligned with the bosses 9. In this configuration, the flexible legs 7 return to their relaxed position. To this end, the bosses 9 have a size similar to or smaller than the width of the slots 11.

Generally speaking, the bosses 9 are arranged angularly around the central cylinder of the body 2 to as to all simultaneously align with respective slots 11 of the pin 5. In the example shown, the two bosses 9 are arranged on the body 2 diametrically opposite each other and four slots 11 of the pin 5 are separated at an angle of 90° from each other.

The top of the handle 10 connects each longitudinal arm 10*a*, 10*b* and holds them firmly in position when the flexible legs 7 bear on and apply forces against the bosses 9.

When the pin 5 is screwed into the body 2 in the direction of insertion to adjust the elevation of the end piece 6, the slots 11 are rotated by retracting the flexible legs 7. The bosses 9 are engaged in some of these slots 11 to index the rotation of the pin 5 and ensure a stationary positioning, in the locking position, of the elevation of the end piece.

In the example shown, each quarter turn of the pin 5 forms a notch for positioning the end piece. Depending on the chosen pitch of the internal and external threads, each quarter turn, i.e., between two locking positions, adjusts the elevation of the end piece 6 by a specified amount.

The parts of the adjustment device 1 just presented may be made of a plastic material, and the device may be manufactured by a molding process (e.g., injection molding) or by an additive manufacturing process.

Of course, the invention is not limited to the described embodiments and alternative solutions can be used without departing from the scope of the invention, as defined in the claims.

What is claimed is:

1. An adjustment device for adjusting an elevation of a piece, the device comprising:

a body intended to be secured to a support, the body having an interior surface defining a central cylindrical bore having a first opening and a second opening, the body further including at least two bosses respectively disposed on longitudinal arms of a handle, the longitudinal arms extending from the second opening; and a pin having an external thread, a first end for bearing the piece, a second end, and at least two longitudinal slots on its second end to define at least two flexible legs, each flexible leg of the at least two flexible legs having a free end comprising a shoulder; and the pin and the body being connected to each other via their respective threads, the pin being inserted into the body to expose the at least two flexible legs outside the body through the second opening and to abut the shoulder of each of the at least two flexible legs against a peripheral edge of the second opening of the body to prevent the pin from unscrewing from the body, and the pin being able, when rotated, to move in a longitudinal direction to adjust the elevation of the first end of the pin, wherein the at least two bosses are configured to bend the at least two flexible legs of the pin when the at least two flexible legs are aligned with the at least two bosses, and to be positioned in the at least two longitudinal slots when the at least two bosses are aligned with the at least two longitudinal slots, during rotational movement of the pin so as to index an elevational position of the piece.

2. The adjustment device of claim 1, wherein a stop is attached to the first end of the pin.

3. The adjustment device of claim 2, wherein the at least two longitudinal slots of the pin comprise four longitudinal slots defining four flexible legs on the pin.

* * * * *